US009441451B2

(12) United States Patent
Jurgensmeier

(10) Patent No.: US 9,441,451 B2
(45) Date of Patent: Sep. 13, 2016

(54) SELF-SETTING DOWNHOLE TOOL

(71) Applicant: HALLIBURTON ENERGY SERVICES, INC., Carrollton, TX (US)

(72) Inventor: Michael James Jurgensmeier, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 581 days.

(21) Appl. No.: 13/957,068

(22) Filed: Aug. 1, 2013

(65) Prior Publication Data

US 2015/0034339 A1 Feb. 5, 2015

(51) Int. Cl.
*E21B 33/13* (2006.01)
*E21B 33/134* (2006.01)
*E21B 33/128* (2006.01)

(52) U.S. Cl.
CPC ..... *E21B 33/134* (2013.01); *E21B 33/128* (2013.01)

(58) Field of Classification Search
CPC . E21B 33/1208; E21B 33/128; E21B 33/134
See application file for complete search history.

(56) References Cited

U.S. PATENT DOCUMENTS 3,659,648 A * 5/1972 Cobbs ..... E21B 33/128 166/120
4,326,588 A 4/1982 McStravick
RE31,978 E 9/1985 McStravick
4,791,992 A * 12/1988 Greenlee ..... E21B 33/128 166/187
5,882,034 A 3/1999 Davis
6,214,138 B1 4/2001 Canterberry
6,251,200 B1 6/2001 Dunne
6,341,654 B1 1/2002 Wilson
6,446,717 B1 9/2002 White et al.
7,172,029 B2 * 2/2007 Hirth ..... E21B 33/128 166/122
7,677,303 B2 * 3/2010 Coronado ..... E21B 33/128 166/187
8,365,835 B2 2/2013 Loughlin
9,169,705 B2 * 10/2015 Helms ..... E21B 23/06
2002/0166672 A1 11/2002 White et al.
2003/0075342 A1 4/2003 Gunnarsson
2004/0069502 A1 4/2004 Luke
2004/0251025 A1 * 12/2004 Giroux ..... E21B 33/16 166/291
2009/0114401 A1 5/2009 Purkis
2009/0255692 A1 * 10/2009 Coronado ..... E21B 33/128 166/387
2011/0079383 A1 * 4/2011 Porter ..... E21B 33/1277 166/118
2011/0132623 A1 * 6/2011 Moeller ..... E21B 43/105 166/382
2011/0168411 A1 7/2011 Braddick
2011/0258834 A1 * 10/2011 Allen ..... F16L 55/132 29/525
2012/0247775 A1 * 10/2012 Moeller ..... E21B 33/1216 166/308.1
2013/0213635 A1 * 8/2013 Carro ..... E21B 33/1293 166/120
2015/0034339 A1 * 2/2015 Jurgensmeier ..... E21B 33/134 166/387

FOREIGN PATENT DOCUMENTS

EP 0763511 A2 3/1997

OTHER PUBLICATIONS

International Search and Written Opinion dated Nov. 7, 2014, issued in corresponding PCT Application No. PCT/US2014/045751.

* cited by examiner

*Primary Examiner* — Daniel P Stephenson
(74) *Attorney, Agent, or Firm* — McAfee & Taft A Professional Corporation

(57) ABSTRACT

A setting apparatus for use on a downhole tool in a wellbore is described. The setting apparatus comprises an expandable member configured for axial expansion under fluid pressure wherein said expansion moves said downhole tool from an unset position to a set position. Generally, the fluid will be a gas generated downhole and can be generated near or in the expandable member.

19 Claims, 5 Drawing Sheets

SELF-SETTING DOWNHOLE TOOL

FIELD

This specification relates generally to downhole tools for use in oil and gas wellbores and methods of anchoring such apparatuses within the wellbore. This specification particularly relates to apparatuses and methods for setting of downhole drillable packer, bridge plug and frac plug tools into an anchored position within the wellbore.

BACKGROUND

In drilling or reworking oil wells, many varieties of downhole tools are used. For example, but not by way of limitation, it is often desirable to seal tubing or other pipe in the casing of the well by pumping cement or other slurry down the tubing, and forcing the slurry around the annulus of the tubing or out into a formation. It then becomes necessary to seal the tubing with respect to the well casing and to prevent the fluid pressure of the slurry from lifting the tubing out of the well, or for otherwise isolating specific zones in a well. Downhole tools referred to as packers, bridge plugs and frac plugs are designed for these general purposes, and are well known in the art of producing oil and gas.

Both packers and bridge plugs are used to isolate the portion of the well below the packer or bridge plug from the portion of the well thereabove. Accordingly, packers and bridge plugs may experience a high differential pressure, and must be capable of withstanding the pressure so that the packer or bridge plug seals the well, and does not move in the well after being set.

Packers and bridge plugs used with a downhole tool both make use of metallic or non-metallic slip assemblies, or slips, that are initially retained in close proximity to a mandrel. These packers and bridge plugs are forced outwardly away from the mandrel upon the downhole tool being set to engage a casing previously installed within an open wellbore. Upon positioning the downhole tool at the desired depth or position, a mechanical or hydraulic setting tool is used to exert force, or load, upon the downhole tool. This loading forces the slips to expand radially outward against the inside of the casing to anchor the packer, or bridge plug, so that the downhole tool will not move relative to the casing.

Alternative means of setting downhole tools, other than mechanical or hydraulic setting tools, are of interest to the oil and gas industry. This is especially true if such alternative means can help reduce cost and/or reduce the chance of failure in the setting process.

Figure 1:
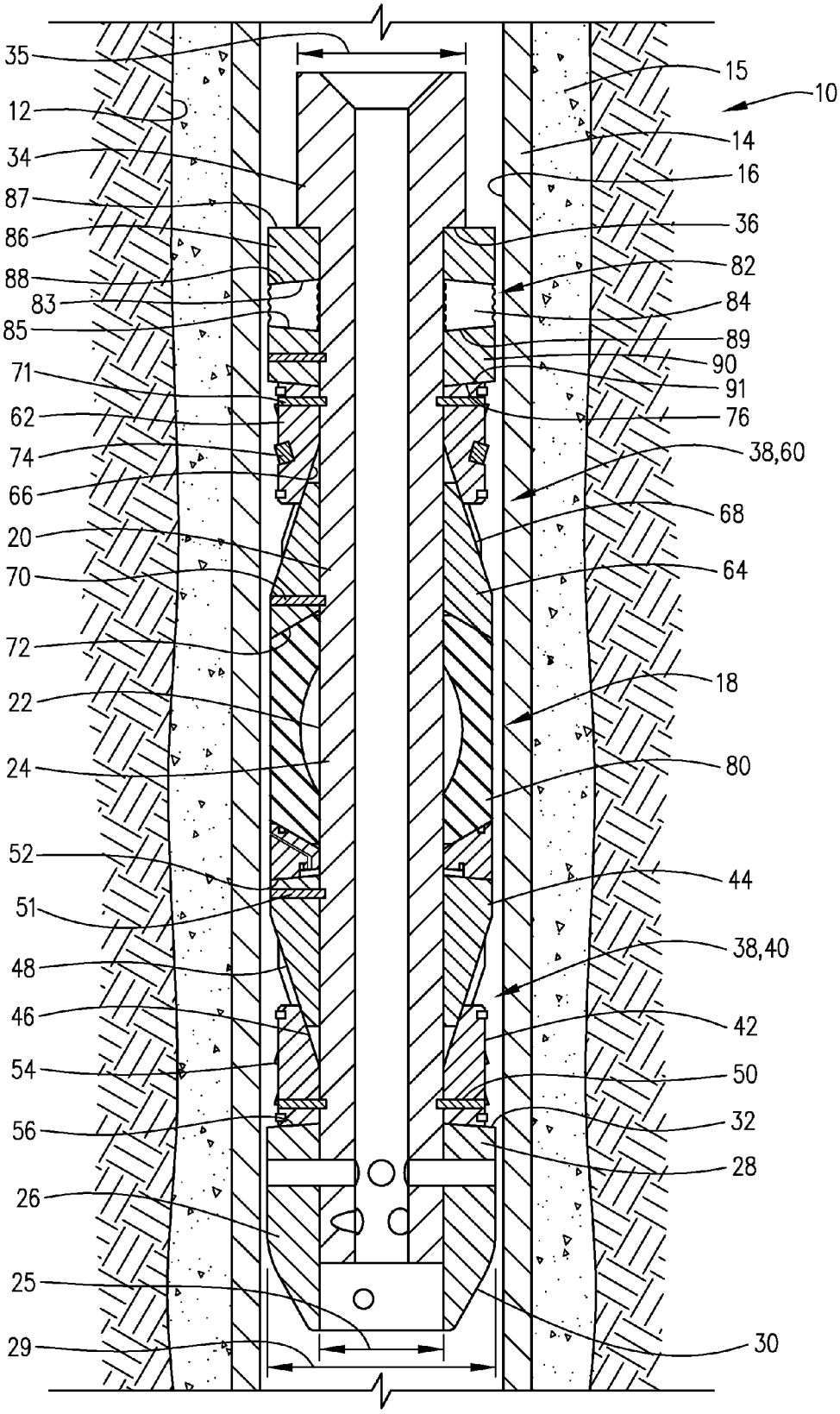
FIG. 1 is a schematic cross-sectional view of a downhole tool in accordance with one embodiment. The downhole tool is shown in an unset position.

The expandable member utilizes a mesh in accordance with an embodiment of the current invention.

DETAILED DESCRIPTION

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. One of ordinary skill in the art will appreciate the many possible applications and variations of the present invention based on the following description.

Figure 2:
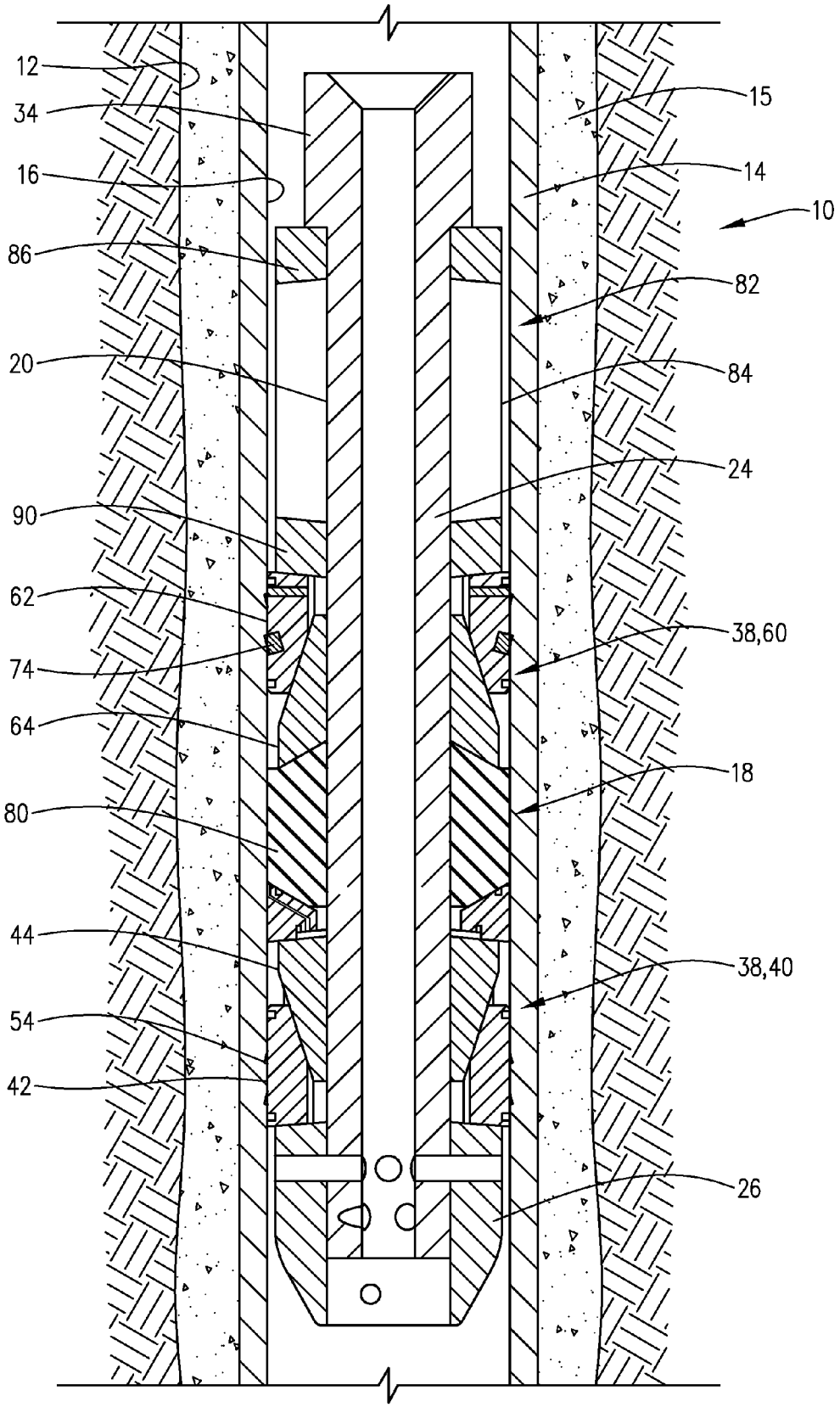
FIG. 2 is a schematic cross-sectional view of the downhole tool of FIG. 1 shown in a set position.

Referring to the drawings, FIGS. 1 and 2 illustrate well 10 having wellbore 12 with casing 14 cemented therein by cement 15. Casing 14 has inner wall 16. The embodiments as described herein are applicable to wellbores with and without casing and, as used herein, the term wellbore will include both wellbores with and without casing cemented therein. Additionally, in the below description, the terms lower, upper, top, bottom and similar are used to describe the elements of a downhole tool; however, it should be understood that such terms are used to indicate the relative position of the elements to one another and that the actual orientation in the well may be different from the description; for example, the downhole tool could be positioned sideways in a laterally extending wellbore.

Within wellbore 12 is downhole tool 18. In the embodiment illustrated in FIGS. 1 and 2, downhole tool 18 is referred to as a packer and allows fluid communication therethrough; however, the elements described can be useful in other downhole tools such as bridge plugs and frac plugs. In FIG. 1, downhole tool 18 is shown in its unset configuration or unset position. In FIG. 2, downhole tool 18 is shown in its set configuration or set position. As illustrated, downhole tool 18 includes central mandrel 20 with an outer surface 22. Mandrel 20 has an axially extending central portion 24, which terminates at first or lower end in end portion or shoe 26 and at a second or upper end in top portion 34. Shoe 26 has a cylindrical portion 28 and a truncated conical portion 30. It will be noted that, cylindrical portion 28 of shoe 26 has a diameter 29, which is greater than the diameter 25 of central portion 24, thus, creating an upward facing shoulder 32. It will also be noted that the diameter 35 of top portion 34 is greater than the diameter 25 of central portion 24; thus, creating a downward facing shoulder 36. Top portion 34 is configured to be connected to a drill string or similar apparatus to lower downhole tool 18 into position.

Downhole tool 18 has anchoring assemblies 38, shown as first or lower slip assembly 40 and second or upper slip assembly 60. Anchoring assemblies 38 provide anchoring for downhole tool 18 to casing 14 within well 10. Anchoring assemblies 38 are positioned on and/or disposed about mandrel 20. The structures of first slip assembly 40 and second slip assembly 60 are similar, although their orientation and position are different.

Lower slip assembly 40 includes at least one slip ring 42 and at least one slip wedge 44. Slip ring 42 has an inclined/wedge-shaped first surface 46 positioned proximate to an inclined/wedge-shaped complementary second surface 48 of slip wedge 44. Lower slip assembly 40 is depicted as being pinned into place with pins 50 and 51 to restrain slip ring 42 from radial movement before downhole tool 18 is set. Upward facing shoulder 32 provides an abutment, which serves to axially retain lower slip assembly 40 from downward movement. As illustrated, upward facing shoulder 32 and end surface 56 of slip ring 42 have complementary inclines so as to facilitate the radially outward movement of slip ring 42 during setting. Additionally, slip wedge 44 can have an angled end surface 52 designed to direct the radial expansion of sealing element 80 when it is compressed.

Slip ring 42 can have wickers 54 or buttons positioned on its outer surface. When downhole tool 18 is in its set position, slip ring 42 and slip wedge 44 slidingly engage so that slip ring 42 is moved radially outward, as illustrated in FIG. 2. In the set position, wickers 54 bite into wellbore 12; thus, anchoring downhole tool 18. Slip ring 42 can be an integral unit of frangibly connected slip segments or can comprise slip segments held in place by retaining bands, as is known in the art.

Upper slip assembly 60 includes at least one slip ring 62 and at least one slip wedge 64. Slip ring 62 has an inclined/wedge-shaped first surface 66 positioned proximate to an inclined/wedge-shaped complementary second surface 68 of slip wedge 64. Upper Slip assembly 60 is depicted as being pinned into place with pins 70 and 71 to restrain slip ring 62 from radial movement before downhole tool 18 is set. Slip wedge 64 can have an angled end surface 72 designed to direct the radial expansion of sealing element 80 when it is compressed. As illustrated, angled end surface 72 of the upper slip assembly 60 forms an acute angle with the mandrel on the element side; whereas, angled end surface 52 of lower slip ring 40 forms an obtuse angle with the mandrel on the element side. Accordingly, the angles of angle end surfaces 52 and 72 are such that the radial expansion of sealing element 80 is directed downward or away from slip wedge 64.

Slip ring 62 can have wickers or buttons 74 positioned on its outer surface. When downhole tool 18 is in its set position, slip ring 62 and slip wedge 64 slidingly engage so that slip ring 62 is moved radially outward, as illustrated in FIG. 2. In the set position, buttons 74 bite into wellbore 12; thus, anchoring downhole tool 18. Buttons 74, or wickers if used, are at an angle such that, after the buttons have engaged the wellbore, the buttons provide resistance to the retraction of slip ring 62 to the unset position. Slip ring 62 can be an integral unit of frangibly connected slip segments or can comprise slip segments held in place by retaining bands, as is known in the art.

Lower slip assembly 40 and upper slip assembly 60 are illustrated in FIGS. 1 and 2 as being separated by sealing element 80. Sealing element 80 comprises at least one expandable sealing element, which under axial compressing expands radially so that sealing element 80 sealingly engages the wellbore 12 in the set position.

Downhole tool 18 includes a setting apparatus 82. Setting apparatus 82 generally comprises an expandable member 84, such as an expandable elastomeric bladder. Expandable member 84 is generally an inflatable member and designed to expand axially upon the introduction of a high pressure fluid. That is, expandable member 84 expands longitudinally along mandrel 20, preferably, with little, if any, radial expansion outward and away from mandrel 20. The high pressure fluid can be a gas or liquid introduced from the surface into expandable member 84 at a pressure suitable for inflating expandable member 84 such that downhole tool 18 is moved to the set position. The high pressure fluid can be an expansive gas, expansive liquid or expansive foam typically generated in situ by a chemical reaction. The reactive chemicals can be ones that react on contact and can be contained in a chamber and separated by a barrier, which is removed or perforated when it is desired to inflate the expandable member; i.e., when the downhole tool is ready to be set. The chamber is in fluid flow communication with the expandable member so that the expansive gas, liquid or foam is introduced into the expandable member. Alternatively, the reactive chemicals can be ones that react by application of a high temperature, such as by a squib, electric match or similar. In this alternative embodiment, the reactive chemicals would not need to be separated by a barrier. In an advantageous embodiment, the high pressure fluid is a gas generated in situ either in expandable member 84 or adjacent to it and then introduced into expandable member 84. As used herein "generated in situ" means generated downhole in or near the downhole tool 18 and, preferably, in the downhole tool in or near expandable member 84.

As illustrated, setting apparatus 82 comprises a first spacer ring 86 and a second spacer ring 90. Downward facing shoulder 36 provides an abutment for uphole side 87 of first spacer ring 86, which serves to axially retain first spacer ring 86 from upward movement. Additionally, downhole side 88 of first spacer ring 86 abuts a first end 83 of expandable member 84; thus, first spacer ring 86 is axially retained on the downhole side by its interaction with expandable member 84. Accordingly, first spacer ring 86 is fixed from axial movement. Additionally, first spacer ring 86 can be fixed in place by other means, such as pins. First spacer ring 86 is generally sized smaller than the diameter of inner wall 16 but large enough to limit extrusion of expandable member 84 over the top of first spacer ring 86.

Second spacer ring 90 has an uphole side 89 and a downhole side 91. Uphole side 89 abuts second end 85 of expandable member 84 and is generally sized smaller than the diameter of inner wall 16 but large enough to limit extrusion of expandable member 84 over the top of second spacer ring 90. Downhole side 91 abuts end surface 76 of slip ring 62. Thus, when expansion member 84 is axially expanded, first spacer ring 86 is restrained from movement and the force supplied by the expansion causes second spacer ring 90 to move axially and apply a setting force to second slip assembly 60 and, thus, set it. This setting force is further transferred so as to set sealing element 80 and lower slip assembly 40.

Figure 3:
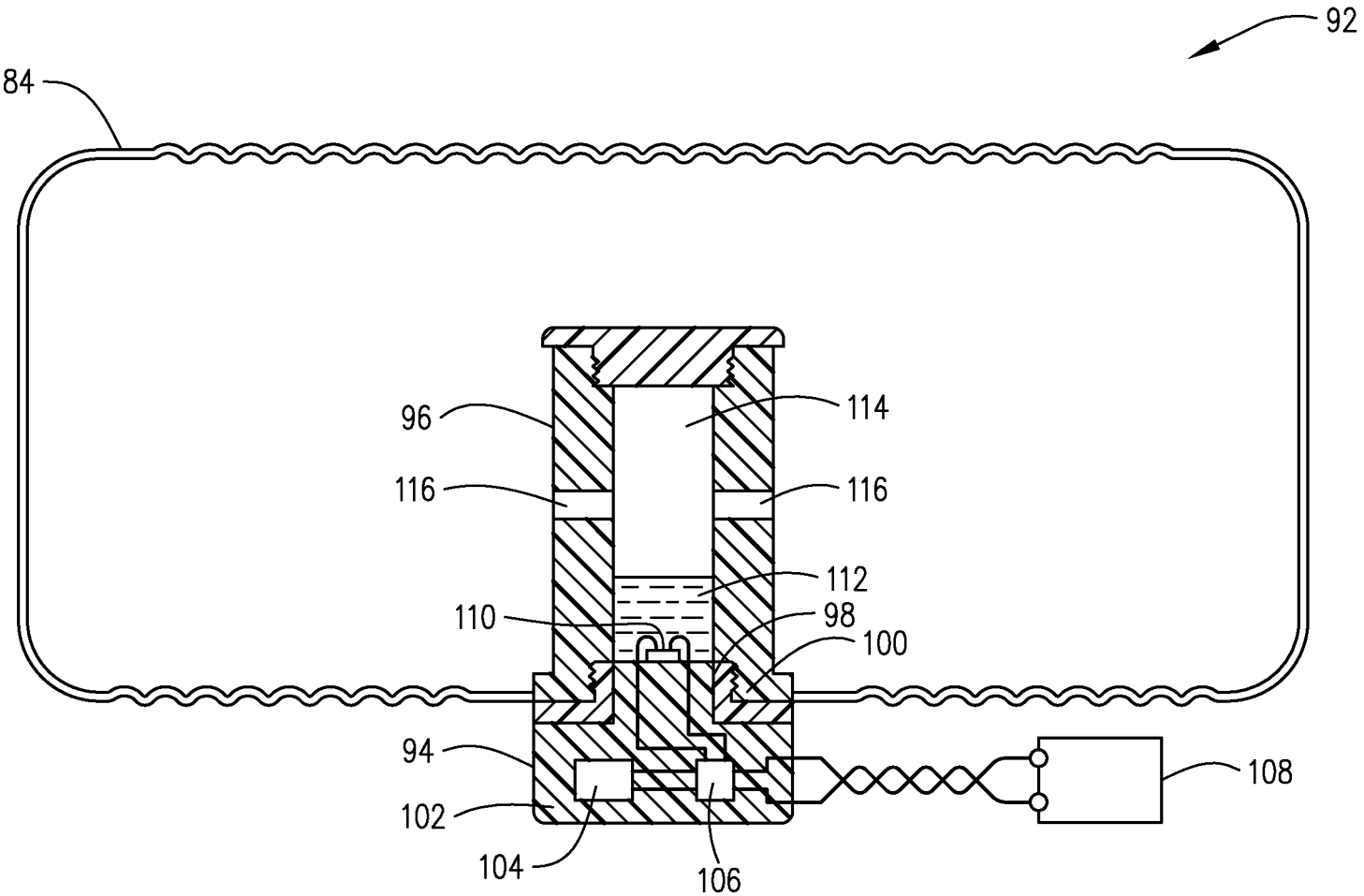
FIG. 3 is a schematic cross-sectional view of an expandable member and an exemplary inflation device.

Turning now to FIG. 3, an embodiment of an expandable member and gas generating assembly suitable for use in the above embodiment invention will be further explained. Expandable member and gas generating assembly 92 includes a remote module 94, an inflator assembly 96 and an expandable member or bladder 84.

Remote module 94 is formed as a plug having a male connector 98, which corresponds to female connector 100 of inflator assembly 96. The male plug forms a housing 102 for capacitor 104 and an integrated circuit 106. The integrated circuit 106 connects to a control module 108, which provides control signals for starting deployment of bladder 84. Control module 108 can be any suitable control module. Control module 108 can be located downhole such as in the case of a downhole sensor or accelerometer used as a control module. Such downhole sensor control modules can be located internal to housing 102 instead of externally, as illustrated. Control module 108 can be located at the surface and connected to remote module 94 through a wire line. Control module 108 is operationally connected to integrated circuit 106 such that, upon control module 108 sending the appropriate control signal, integrated circuit 106 initiates the inflation sequence by providing an electrical pulse from capacitor 104 to inflator assembly 96.

Inflator assembly 96 includes igniter 110, which can be a squib, electric match or similar. Igniter 110 is mounted in inflator assembly 96 to contact igniter pyrotechnic material 112. Leads of igniter 110 connect to a male connector 98 of remote module 94 and place igniter 110 in electrical contact with remote module 94.

Pyrotechnical material 112 is at the base of chamber 114. Chamber 114 is in fluid flow contact with bladder 84 through channels 116, which allow for the release of gases generated by pyrotechnic material 112 into bladder 84. Pyrotechnical material 112 is designed to provide for the rapid inflation of expandable member or bladder 84. Generally, appropriate materials are known in the art area of vehicle safety airbag deployment. For example, pyrotechnical material 112 can be a mixture of $NaN_3$, $KNO_3$, and $SiO_2$. When igniter 110 is set off, a series of three chemical reactions produce gas ($N_2$) to fill the bladder 84 and convert $NaN_3$ to harmless gas. Sodium azide ($NaN_3$) can decompose at 300° C. to produce sodium metal (Na) and nitrogen gas ($N_2$). The control signal from control module 108 activates igniter 110 to ignite the pyrotecnical material 112, creating the high-temperature condition necessary for $NaN_3$ to decompose. The nitrogen gas that is generated then fills bladder 84. The generated sodium reacts with potassium nitrate ($KNO_3$) to produce potassium oxide ($K_2O$), sodium oxide ($Na_2O$), and additional $N_2$ gas. The $N_2$ generated in this second reaction also fills the bladder 84, and the resulting metal oxides react with silicon dioxide ($SiO_2$) in a final reaction to produce silicate gas, which is harmless and stable.

In operation, downhole tool 18 is introduced into the wellbore 12 by a wireline. Downhole tool 18 is then positioned at the desired depth or location. Once in position, a control signal is sent to remote module 94, which sends an electric pulse to igniter 110. Inflator assembly 96 includes igniter pyrotechnic material 112 that contacts igniter 110. Igniter 110 generates heat when a conductive path is formed by remote module 94 coupling current from a capacitor 104 through igniter 110. The heat generated by igniter 110 ignites pyrotechnic material 112. Chamber 114 couples gases released by the ignited pyrotechnic material 112 to bladder 84 so that it expands axially. The axial expansion of bladder 84 results in an axial force applied to second spacer ring 90, which moves axially towards second slip assembly 60 causing slip wedge 64 and slip ring 62 to move relative to one another. Slip wedge 64 has inclined surface 68 defined thereon. Slip ring 62 radially expands outward as complementary second surface 68 slides against inclined first surface 66 of slip wedge 64. The sliding effect of complementary inclined second surface 68 against inclined first surface 66 causes slip ring 62 to expand outward and forces buttons 74 on slip ring 62 against inner wall 16; thus anchoring downhole tool 18 in place and providing resistance to the retraction of slip ring 62 to the unset position due to the angling of buttons 74.

Additionally, slip wedge 64 moves axially under the axial force to compress sealing element 80 such that it expands radially to seal against inner wall 16. The compression of sealing element 80 transfers the axial force to slip wedge 44 of first slip assembly 40, which moves slip wedge 44 axially causing slip wedge 44 and slip ring 42 to move relative to one another. Slip wedge 44 has inclined surface 48 defined thereon. Slip ring 42 radially expands outward as complementary second surface 48 slides against inclined first surface 46 of slip wedge 44. The sliding effect of complementary inclined second surface 48 against inclined first surface 46 causes slip ring 42 to expand outward and forces wickers buttons 54 on slip ring 42 against inner wall 16; thus, providing further anchoring for downhole tool 18.

Generally after downhole tool 18 has been set, expandable member 84 can be allowed to collapse. Typically, the expansion of the expandable member 84 and the setting of downhole tool 18 can take less than a second. More typically the expansion and setting can take less than half a second and can take less than tenth of a second.

Figure 4:
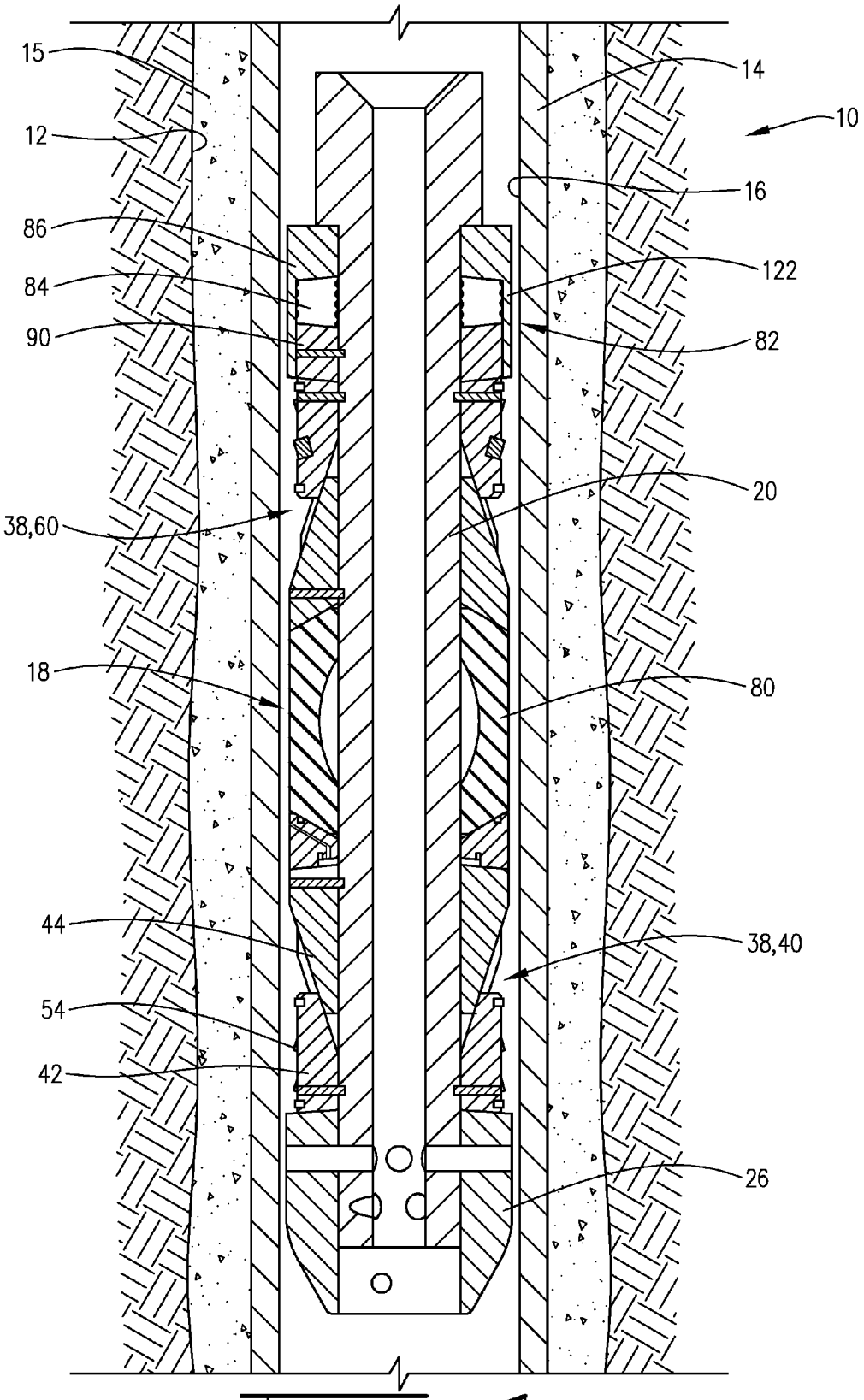
FIG. 4 is a schematic cross-sectional view of a downhole tool in accordance with another embodiment. The downhole tool is shown in an unset position.
Figure 5:
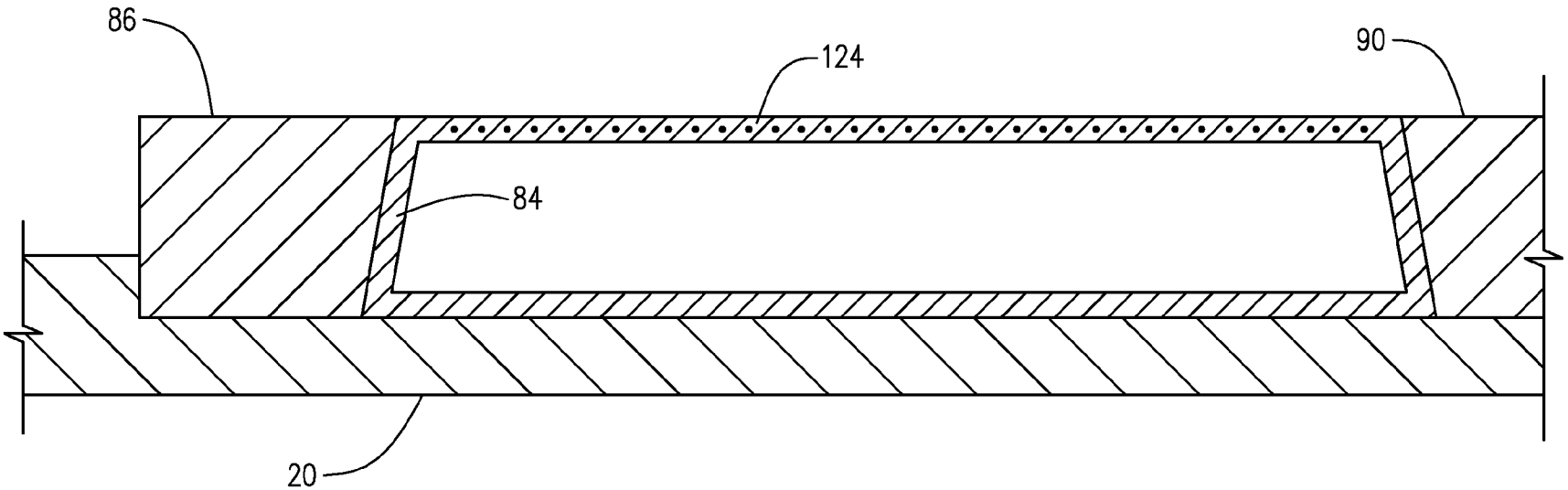
FIG. 5 is a schematic cross-sectional view of the expandable member portion of a downhole tool in the set position.

Generally, in use the shape of expandable member 84 and the borehole will provide sufficient limitation on the radial expansion of expandable member 84 and insure adequate axial expansion; thus, once the expandable member 84 meets the wellbore 12, radial expansion will stop but axial expansion will continue until the downhole tool 18 is set. In some applications, it may be desirable to limit radial expansion of expandable member 84 before it meets the wellbore 12; such as to increase the applied axial force. FIG. 4 illustrates one embodiment designed to restrict the radial expansion of expandable member 84. In the embodiment of FIG. 4, an expansion sleeve 122 is disposed about expandable member 84 to limit its radial expansion. FIG. 5 illustrates an alternative embodiment designed to restrict the radial expansion of expandable member 84. FIG. 5 is a view of the expandable member portion of a downhole tool in the set position. In FIG. 5, expandable member 84 has embedded therein a mesh 124 designed to allow axial expansion but restrict radial expansion. Mesh 124 can, for example, be circumferentially oriented fibers made of any suitable material having a high tensile strength, such as, metal or carbon composite materials.

In accordance with the above description, one embodiment provides for a downhole tool for use in a wellbore comprising a mandrel, a first spacer ring, a second spacer ring, an expandable member, an anchoring assembly and a sealing element. The first and second spacer rings are disposed about the mandrel. The first spacer ring is fixed from axial movement. The expandable member is disposed about the mandrel and disposed between the first spacer ring and the second spacer ring. The expandable member expands axially under fluid pressure such that the expansion moves the second spacer ring axially. The anchoring assembly and sealing element are operationally connected to the second spacer ring such that when the second spacer ring moves axially the anchoring assembly and sealing element move from an unset position to a set position.

In accordance with a further embodiment of the downhole tool the expandable member is expanded by a gas. The gas can be formed within the expandable member by a reaction of chemicals initiated by an electrical pulse. Also, there can be a sleeve disposed about the expandable member so that the sleeve limits radial expansion of the expandable member. Alternatively, the expandable member can be comprised of a mesh, which allows axial expansion but limits radial expansion of the expandable member.

In accordance with the above description another embodiment provides for a setting apparatus for use on a downhole tool in a wellbore comprising an expandable member configured for axial expansion under fluid pressure wherein the axial expansion moves the downhole tool from an unset position to a set position.

In accordance with a further embodiment of the setting apparatus the expandable member is expanded by the in situ generation of a high pressure fluid. The high pressure fluid can be a gas. The gas can be formed within the expandable member by a reaction of chemicals initiated by an electrical pulse. The chemicals can react to produce $N_2$. The chemicals can be a mixture of $NaN_3$, $KNO_3$, and $SiO_2$.

In another embodiment of the setting apparatus a sleeve can be disposed about the expandable member so that the sleeve limits radial expansion of the expandable member. Alternatively, the expandable member can be comprised of a mesh, which allows axial expansion but limits radial expansion of the expandable member.

In yet a further embodiment, the downhole tool has an anchor assembly and the setting apparatus is operationally connected to the anchor assembly such that expansion of the expandable member moves the anchor assembly from the unset position to the set position so that the downhole tool is anchored from axial movement in the wellbore. Additionally, the setting apparatus can further comprise a first spacer ring and a second spacer ring. The first spacer ring can be fixed from axial movement. The expandable member can be disposed between the first spacer ring and the second spacer ring wherein expansion of the expandable member moves the second spacer ring axially. Further, the setting apparatus can be operationally connected to the anchor assembly such that axial movement of the second spacer ring moves the anchor assembly and sealing element from an unset position to a set position so that the downhole tool is anchored from axial movement in the wellbore and the sealing element sealing engages the wellbore.

In accordance with still another embodiment of the invention there is provided a method of anchoring a downhole tool in a wellbore comprising:

(a) introducing the downhole tool having an expandable member into the casing to locate the downhole tool at a desired position; and (b) providing fluid pressure to the expandable member to axially expand the expandable member such that the downhole tool is moved from an unset position in which the downhole tool is not anchored to a set position in which the downhole tool is anchored in the wellbore.

Step (b) of the method can comprise providing an electrical pulse to a chemical associated with the expandable member such that the electrical pulse causes the chemical to undergo a gas producing chemical reaction sufficient for the gas to inflate the expandable member and cause axial expansion. The gas can be $N_2$ and the chemical can be a mixture of $NaN_3$, $KNO_3$, and $SiO_2$.

Further, the downhole tool can be configured such that, after the downhole tool is set, the fluid pressure is released and the downhole tool stays in the set position upon release of the fluid pressure. Also, the expandable member can be physically limited from expanding in the radial direction.

Other embodiments will be apparent to those skilled in the art from a consideration of this specification or practice of the embodiments disclosed herein. Thus, the foregoing specification is considered merely exemplary with the true scope thereof being defined by the following claims.

What is claimed is:

1. A downhole tool for use in a wellbore comprising:

a mandrel;

a first spacer ring disposed about said mandrel, said first spacer ring being fixed from axial movement;

a second spacer ring disposed about said mandrel;

an expandable member disposed about said mandrel and disposed between said first spacer ring and said second spacer ring wherein said expandable member expands axially under fluid pressure such that said expansion moves said second spacer ring axially;

an anchoring assembly; and a sealing element, wherein said anchoring assembly and sealing element are operationally connected to said second spacer ring such that when said second spacer ring moves axially said anchoring assembly and sealing element move from an unset position to a set position.

2. The downhole tool of claim 1 wherein said expandable member is expanded by a gas.

3. The downhole tool of claim 2 wherein said gas is formed within said expandable member by a reaction of chemicals initiated by an electrical pulse.

4. The downhole tool of claim 1 further comprising a sleeve disposed about said expandable member so that said sleeve limits radial expansion of said expandable member.

5. The downhole tool of claim 1 wherein said expandable member is comprised of a mesh, which allows axial expansion but limits radial expansion of said expandable member.

6. A setting apparatus for use on a downhole tool in a wellbore comprising:

an expandable member configured for axial expansion under fluid pressure, wherein said expansion moves said downhole tool from an unset position to a set position, and wherein said expandable member is expanded by the in situ generation of a high pressure gas formed within said expandable member by a reaction of chemicals initiated by an electrical pulse.

7. The setting apparatus of claim 6 wherein said chemicals react to produce $N_2$.

8. The setting apparatus of claim 7 wherein said chemicals are a mixture of $NaN_3$, $KNO_3$, and $SiO_2$.

9. The setting apparatus of claim 7 further comprising a sleeve disposed about said expandable member so that said sleeve limits radial expansion of said expandable member.

10. The downhole tool of claim 7 wherein said expandable member is comprised of a mesh, which allows axial expansion but limits radial expansion of said expandable member.

11. The setting apparatus of claim 6 wherein said downhole tool has an anchor assembly and said setting apparatus is operationally connected to said anchor assembly such that expansion of said expandable member moves said anchor assembly from said unset position to said set position so that said downhole tool is anchored from axial movement in said wellbore.

12. The setting apparatus of claim 6 wherein said setting apparatus further comprises:

a first spacer ring, said first spacer ring being fixed from axial movement; and a second spacer ring wherein said expandable member is disposed between said first spacer ring and said second spacer ring and wherein expansion of said expandable member moves said second spacer ring axially.

13. The setting apparatus of claim 12 wherein said downhole tool has an anchor assembly and a sealing element and wherein said setting apparatus is operationally connected to said anchor assembly such that axial movement of said second spacer ring moves said anchor assembly and sealing element from an unset position to a set position so that said downhole tool is anchored from axial movement in said wellbore and said sealing element sealing engages said wellbore.

14. The setting apparatus of claim 13 wherein said expandable member is expanded by $N_2$ formed within said expandable member by a reaction of a mixture of NaN3, $KNO_3$, and $SiO_2$ initiated by an electrical pulse.

15. A method of anchoring a downhole tool in a wellbore comprising:

(a) introducing said downhole tool having an expandable member into said wellbore to locate said downhole tool at a desired position; and (b) providing fluid pressure to said expandable member to axially expand said expandable member such that said downhole tool is moved from an unset position in which said downhole tool is not anchored to a set position in which said downhole tool is anchored in said wellbore, wherein said providing fluid pressure to said expandable member comprises providing an electrical pulse to a chemical associated with said expandable member such that said electrical pulse causes said chemical to undergo a gas producing chemical reaction sufficient for said gas to inflate said expandable member and cause axial expansion.

16. The method of claim 15 wherein said gas is $N_2$.

17. The method of claim 16 wherein said chemical is a mixture of $NaN_3$, $KNO_3$, and $SiO_2$.

18. The method of claim 15 wherein, after said downhole tool is set, said fluid pressure is released and said downhole tool is configured to stay in said set position upon release of said fluid pressure.

19. The method of claim 15 wherein said expandable member is physically limited from expanding in the radial direction.

* * * * *